US008206129B2

(12) United States Patent
Sanderson

(10) Patent No.: US 8,206,129 B2
(45) Date of Patent: Jun. 26, 2012

(54) SUPERCHARGED INTERNAL COMBUSTION ENGINE INCLUDING A PRESSURIZED FLUID OUTLET

(76) Inventor: Robert A. Sanderson, Denton, TX (US)

( * ) Notice: Subject to any disclaimer, the term of this patent is extended or adjusted under 35 U.S.C. 154(b) by 382 days.

(21) Appl. No.: 12/509,478

(22) Filed: Jul. 26, 2009

(65) Prior Publication Data

US 2010/0043735 A1 Feb. 25, 2010

Related U.S. Application Data

(60) Provisional application No. 61/083,938, filed on Jul. 27, 2008.

(51) Int. Cl.
*F04B 3/00* (2006.01)
*F04B 5/00* (2006.01)

(52) U.S. Cl. ..... 417/259; 417/262; 417/264; 417/380; 417/530; 123/62; 123/560

(58) Field of Classification Search ..... 417/246, 417/255, 257, 259, 261, 262, 264, 271, 364, 417/380, 523, 530; 123/25 R, 62, 63, 66, 123/71 R, 71 V, 559.1, 559.2, 560, 562, 565
See application file for complete search history.

(56) References Cited

U.S. PATENT DOCUMENTS

| | | | | |
|---|---|---|---|---|
| 2,168,828 | A * | 8/1939 | Pateras Peseara | 417/340 |
| 4,344,742 | A * | 8/1982 | Ferris | 417/343 |
| 4,415,313 | A * | 11/1983 | Bouthors et al. | 417/38 |
| 4,876,991 | A * | 10/1989 | Galitello, Jr. | 123/46 E |
| 5,167,292 | A * | 12/1992 | Moiroux et al. | 180/165 |
| 2006/0213466 | A1 * | 9/2006 | Hofbauer | 123/46 R |
| 2009/0007861 | A1 * | 1/2009 | Major | 123/63 |

* cited by examiner

*Primary Examiner* — Devon C Kramer
*Assistant Examiner* — Ryan Gatzemeyer
(74) *Attorney, Agent, or Firm* — James Earl Lowe, Jr.

(57) ABSTRACT

A supercharged internal combustion engine including a pressurized fluid outlet, the engine comprising a two-ended piston, with one end received in a combustion chamber, and another end received in a hydraulic chamber. The piston further including a portion intermediate the two ends and received within an air chamber, and the air chamber has an air outlet communicating with a combustion air inlet to the combustion chamber.

8 Claims, 16 Drawing Sheets

SUPERCHARGED INTERNAL COMBUSTION ENGINE INCLUDING A PRESSURIZED FLUID OUTLET

BACKGROUND

This disclosure relates to a two-ended piston assembly producing three outputs, such as a supercharged internal combustion engine including a pressurized fluid outlet.

This disclosure is an improvement to the subject matter of Sanderson et al U.S. Pat. No. 6,397,794 issued Jun. 4, 2002.

SUMMARY

Sanderson et al U.S. Pat. No. 6,397,794 describes double-end piston assemblies that have different functions on opposite ends, such as engine pistons, on one end and hydraulic, or, water pump pistons on the other. There is another capability that has not been specifically identified, and it was discovered while investigating the addition of compressor pistons opposite the engine pistons. Since water, or hydraulic pistons, are much smaller than the pistons required for super-charging, it became apparent that those smaller pistons could be an extension beyond the compressor pistons and not interfere with their function. On an engine this would allow the providing of super-charging, while still providing hydraulic, or water pumping. Also, one could add compressed air, and pumping, to an engine with little change to the mechanism used for an engine alone.

An engine using this concept outputs three functions, if not using the air compressor pistons for super-charging. The three would then be; an air compressor, a pump, and a rotating drive through the output shaft, with the engine power divided to provide the right amount to each function.

This disclosure provides an assembly including a two-ended piston, with one end received in a combustion chamber, and another end received in a hydraulic chamber. The piston further includes a portion intermediate the two ends and received within an air chamber.

This disclosure also provides a supercharged internal combustion engine including a pressurized fluid outlet, the engine comprising a two-ended piston, with one end received in a combustion chamber, and another end received in a hydraulic chamber. The piston further including a portion intermediate the two ends and received within an air chamber, and the air chamber has an air outlet communicating with a combustion air inlet to the combustion chamber.

BRIEF DESCRIPTION OF THE DRAWINGS

FIG. 19A is a side view of the double ended piston of FIG. 19, taken along lines 19-A, 19-A;

FIG. 20 *a* is an end view of the four cylinder engine, taken along lines 20-*a*, 20-*a* of FIG. 20;

Figure 1:
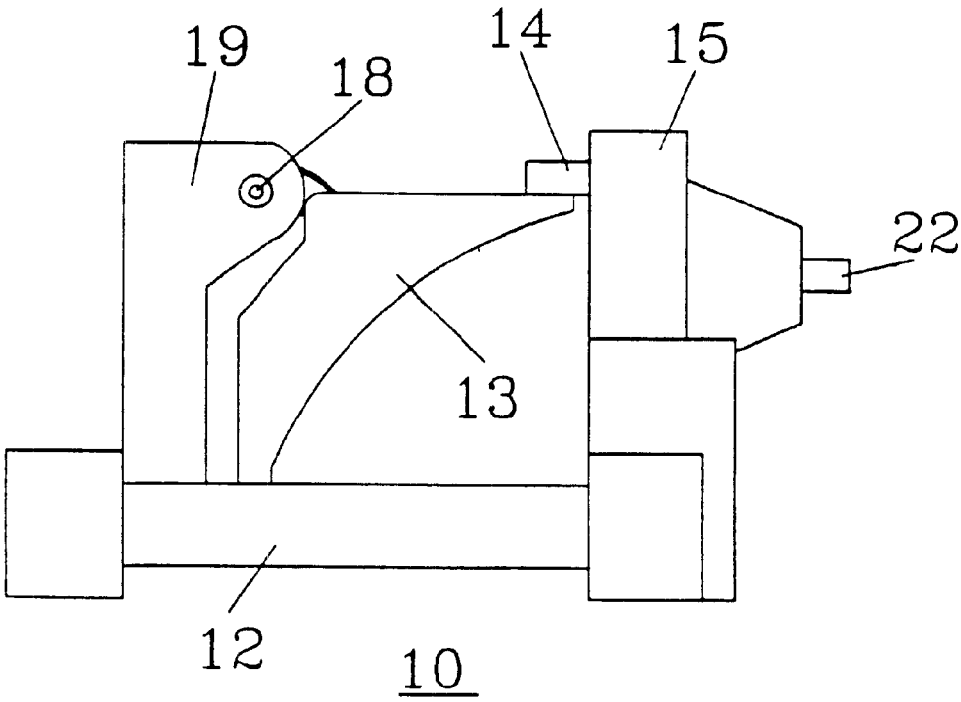
FIGS. 1 and 2 are side view of a simplified illustration of a four cylinder engine.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

FIG. 1 is a pictorial representation of a four piston engine 10. Engine 10 has two cylinders 11 (FIGS. 3) and 12. Each cylinder 11 and 12 house a double ended piston. Each double ended piston is connected to transition arm 13 which is connected to flywheel 15 by shaft 14. Transition arm 13 is connected to support 19 by a universal joint mechanism, including shaft 18, which allows transition arm 13 to move up and down, and shaft 17, which allows transition arm 13 to move side to side. FIG. 1 shows flywheel 15 in a position where shaft 14 is at the top of wheel 15.

Figure 2:
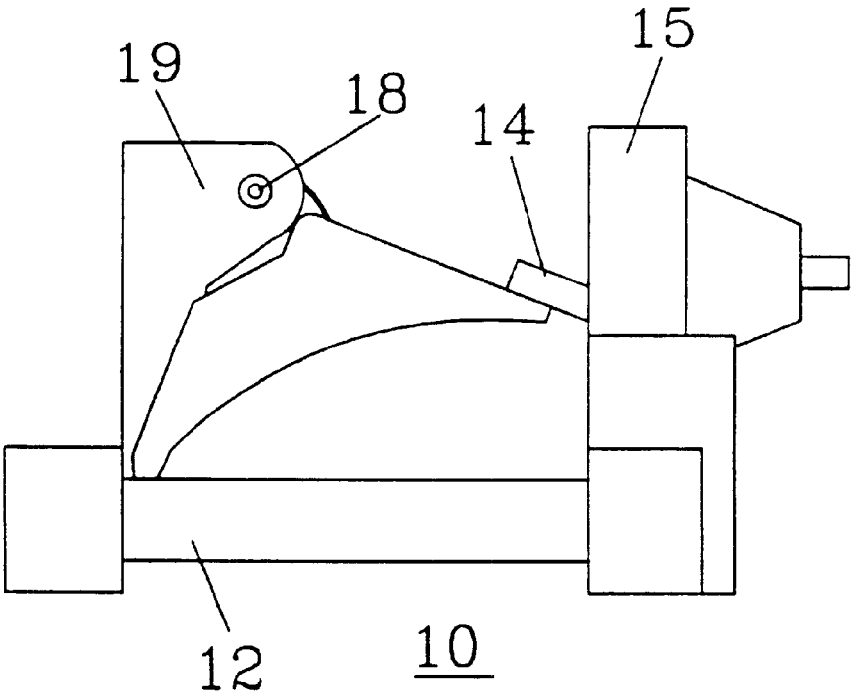

FIG. 2 shows engine 10 with flywheel 15 rotated so that shaft 14 is at the bottom of flywheel 15. Transition arm 13 has pivoted downward on shaft 18.

Figure 3:
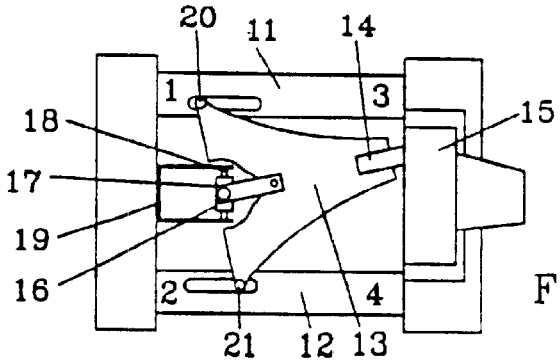
FIGS. 3, 3-*a*, 4, 4-*a*, 5, 5-*a*, and 6, 6-*a* are a top views of the engine of FIG. 1 showing the pistons and flywheel in four different positions.
Figure 3A:
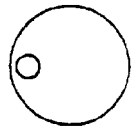
Figure 4:
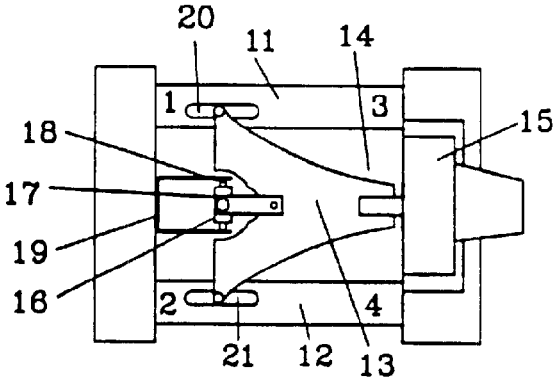
Figure 4A:
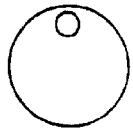
Figure 5:
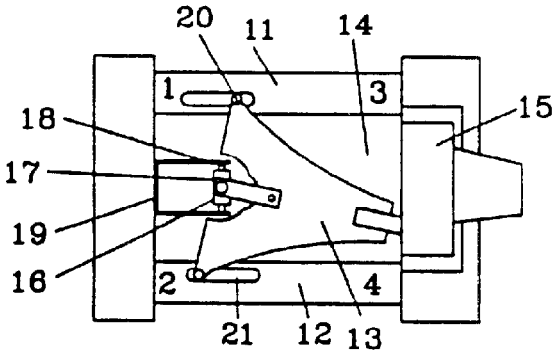
Figure 5A:
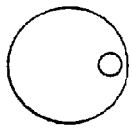
Figure 6:
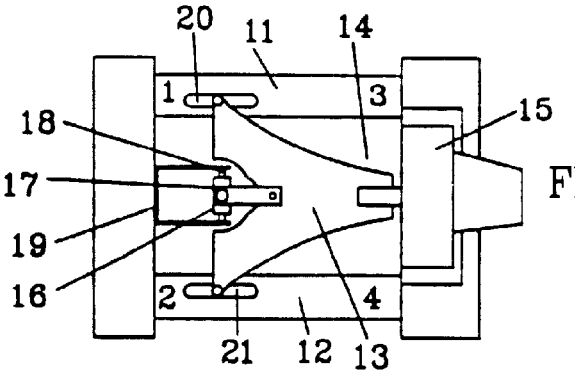
Figure 6A:
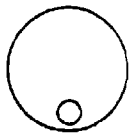

FIGS. 3-6 show a top view of the pictorial representation, showing the transition arm 13 in four positions and the shaft 14 moving flywheel 15 in 900 degree increments. FIG. 3 shows flywheel 15 with shaft 14 in the position as illustrated in FIG. 3-*a*. When piston 1 fires and moves toward the middle of cylinder 11, transition arm 13 will pivot on universal joint 16 rotating flywheel 15 to the position shown in FIG. 2. Shaft 14 will be in the position shown in FIG. 4-*a*. When piston 4 is fired, transition arm 13 will move to the position shown in FIG. 5. Flywheel 15 and shaft 14 will be in the position shown in FIG. 5-*a*. Next piston 2 will fire and transition arm 13 will be moved to the position shown in FIG. 6. Flywheel 15 and shaft 14 will be in the position shown in FIG. 6-*a*. When piston 3 is fired, transition arm 13 and flywheel 15 will return to the original position, that shown in FIGS. 3 and 3-*a*.

When the pistons fire, transition arm will be moved back and forth with the movement of the pistons. Since transition arm 13 is connected to universal joint 16 and to flywheel 15 through shaft 14, flywheel 15 rotates translating the linear motion of the pistons to a rotational motion.

Figure 7:
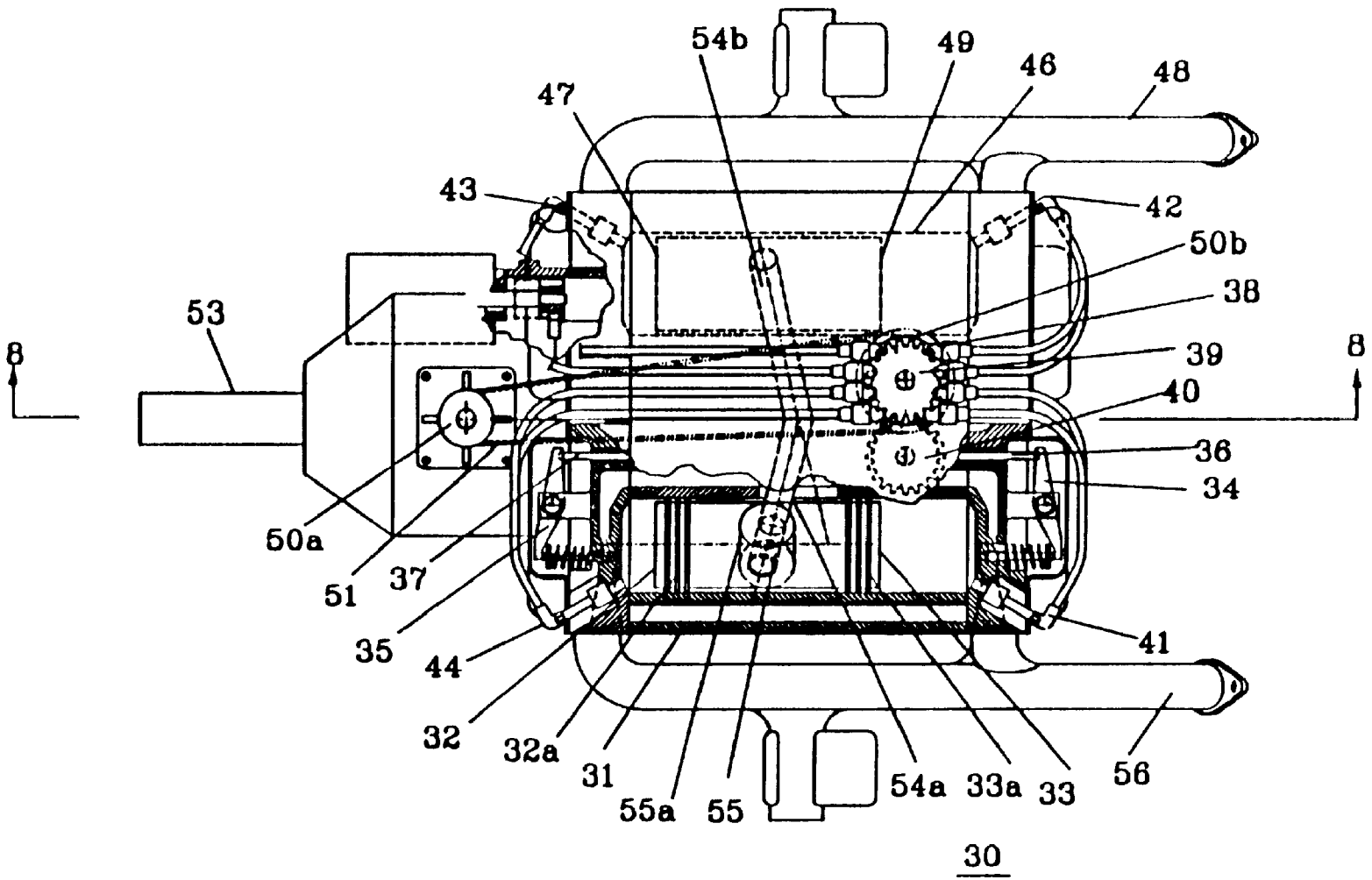
FIG. 7 is a top view, partially in cross-section of an eight cylinder engine.

FIG. 7 shows (in partial cross-section) a top view of an embodiment of a four double piston, eight cylinder engine 30. There are actually only four cylinders, but with a double piston in each cylinder, the engine is equivalent to an eight cylinder engine. Two cylinders 31 and 46 are shown. Cylinder 31 has double ended piston 32, 33 with piston rings 32-*a* and 33-*a*, respectively. Pistons 32, 33 are connected to a transition arm 60 (FIG. 8) by piston arm 54-*a* extending into opening 55-*a* in piston 32, 33 and sleeve bearing 55. Similarly piston 47, 49, in cylinder 46 is connected by piston arm 54-*b* to transition arm 60.

Each end of cylinder 31 has inlet and outlet valves controlled by rocker arms and a spark plug. Piston end 32 has rocker arms 35-*a* and 35-*b* and spark plug 44, and piston end 33 has rocker arms 34-*a* and 34*b*, and spark plug 41. Each piston has associated with it a set of valves, rocker arms and a spark plug. Timing for firing the spark plugs and opening and closing the inlet and exhaust values is controlled by a timing belt 51 which is connected to pulley 50-*a*. Pulley 50-*a* is attached to a gear 64 by shaft 63 (FIG. 8) turned by output shaft 53 powered by flywheel 69. Belt 50-*a* also turns pulley 50-*b* and gear 39 connected to distributor 38. Gear 39 also turns gear 40. Gears 39 and 40 are attached to cam shaft 75 (FIG. 8) which in turn activate push rods that are attached to the rocker arms 34, 35 and other rocker arms not illustrated.

Exhaust manifolds 48 and 56 as shown attached to cylinders 46 and 31 respectively. Each exhaust manifold is attached to four exhaust ports.

Figure 8:
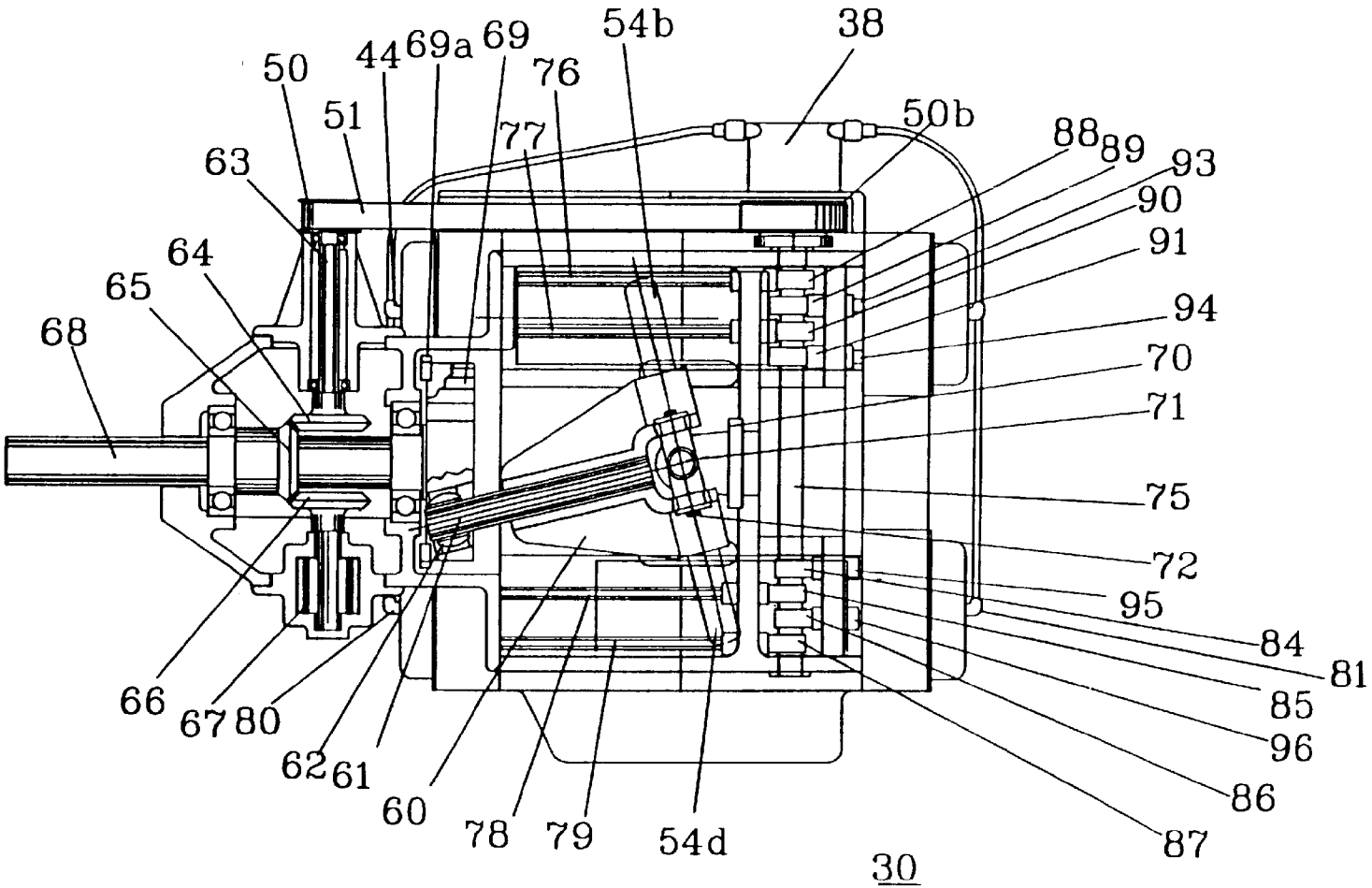
FIG. 8 is a side view in cross-section of the engine of FIG. 7.

FIG. 8 is a side view of engine 30, with one side removed, and taken through section 8-8 of FIG. 7. Transitions arm 60 is mounted on support 70 by pin 72 which allows transition arm to move up and down (as viewed in FIG. 8) and pin 71 which allows transition arm 60 to move from side to side. Since transition arm 60 can move up and down while moving side to side, then shaft 61 can drive flywheel 69 in a circular path. The four connecting piston arms (piston arms 54-*b* and 54-*d* shown in FIG. 8) are driven by the four double end pistons in an oscillator motion around pin 71. The end of shaft 61 in flywheel 69 causes transition arm 60 to move up and down as the connection arms move back and forth. Flywheel 69 has gear teeth 69-*a* around one side which may be used for turning the flywheel 69 with a starter motor 100 (FIG. 11) to start the engine.

The rotation of flywheel 69 and drive shaft 68 connected thereto, turns gear 65 which in turn turns gears 64 and 66. Gear 64 is attached to shaft 63 which turns pulley 50-*a*. Pulley 50-*a* is attached to belt 51. Belt 51 turns pulley 50-*b* and gears 39 and 40 (FIG. 7). Cam shaft 75 has cams 88-91 on one end and cams 84-87 on the other end. Cams 88 and 90 actuate push rods 76 and 77, respectively. Cams 89 and 91 actuate push rods 93 and 94, respectively. Cams 84 and 86 actuate push rods 95 and 96, respectively, and cams 85 and 87 actuate push rods 78 and 79, respectively. Push rods 77, 76, 93, 94, 95, 96 and 78, 79 are for opening and closing the intake and exhaust valves of the cylinders above the pistons. The left side of the engine, which has been cutaway, contains an identical, but opposite valve drive mechanism.

Gear 66 turned by gear 65 on drive shaft 68 turns pump 67, which may be, for example, a water pump used in the engine cooling system (not illustrated), or an oil pump.

Figure 9:
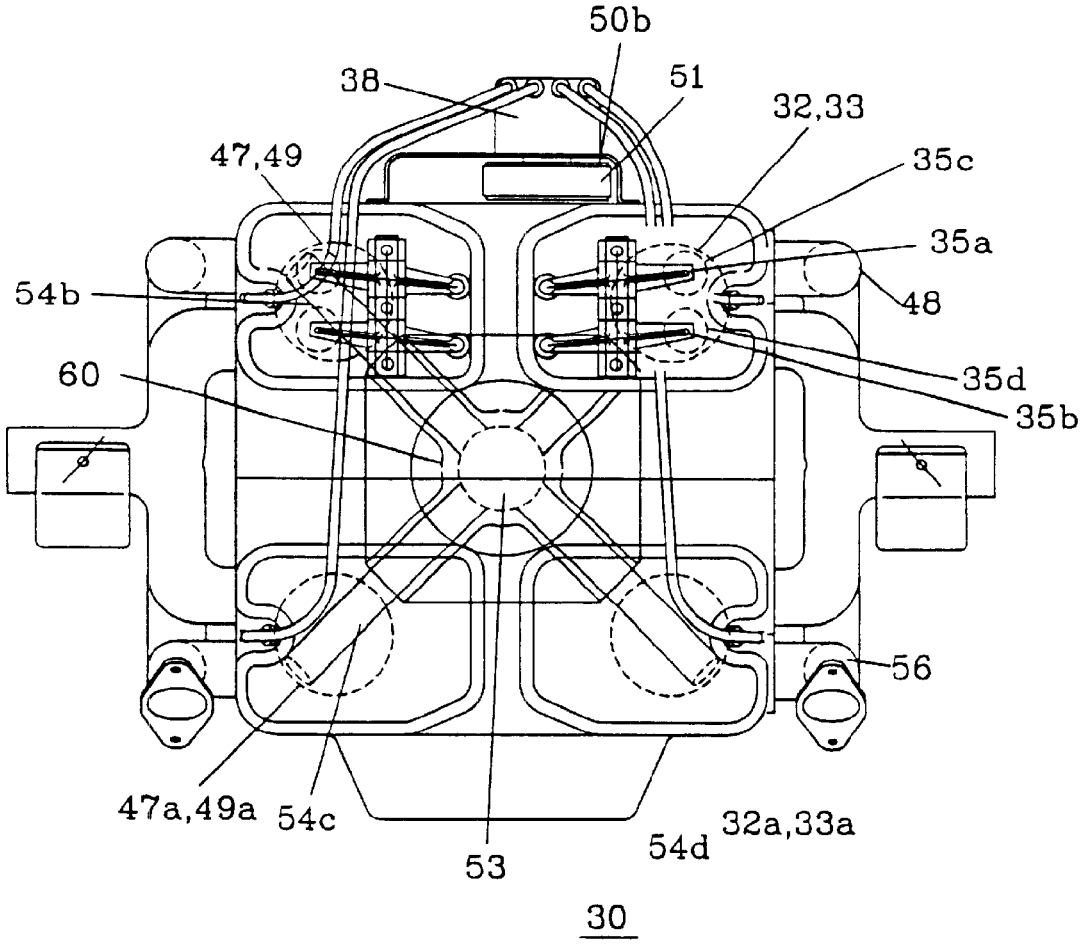
FIG. 9 is a right end view of FIG. 7.

FIG. 9 is a rear view of engine 30 showing the relative positions of the cylinders and double-ended pistons. Piston 32, 33 is shown in dashed lines with valves 35-*c* and 35-*d* located under lifter arms 35-*a* and 35-*b*, respectively. Belt 51 and pulley 50-*b* are shown under distributor 38. Transition arm 60 and two, 54-*c* and 54*d*, of the four piston arms 54-*a*, 54-*b*, 54-*c* and 54-*d* are shown in the pistons 32-33, 32-*a* -33*a*, 47-49 and 47*a* -49-*a*.

Figure 10:
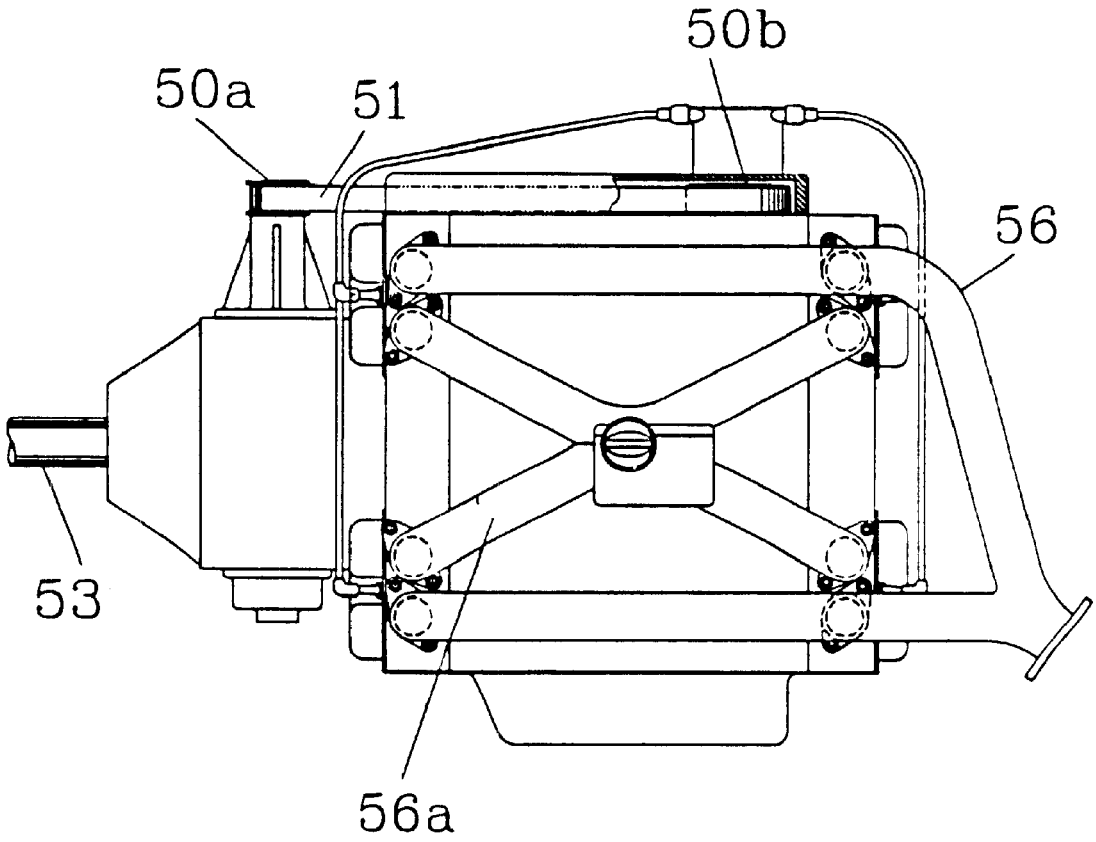
FIG. 10 is a side view of FIG. 7.

FIG. 10 is a side view of engine 30 showing the exhaust manifold 56, intake manifold 56-*a* and carburetor 56-*c*. Pulleys 50-*a* and 50-*b* with timing belt 51 are also shown.

Figure 11:
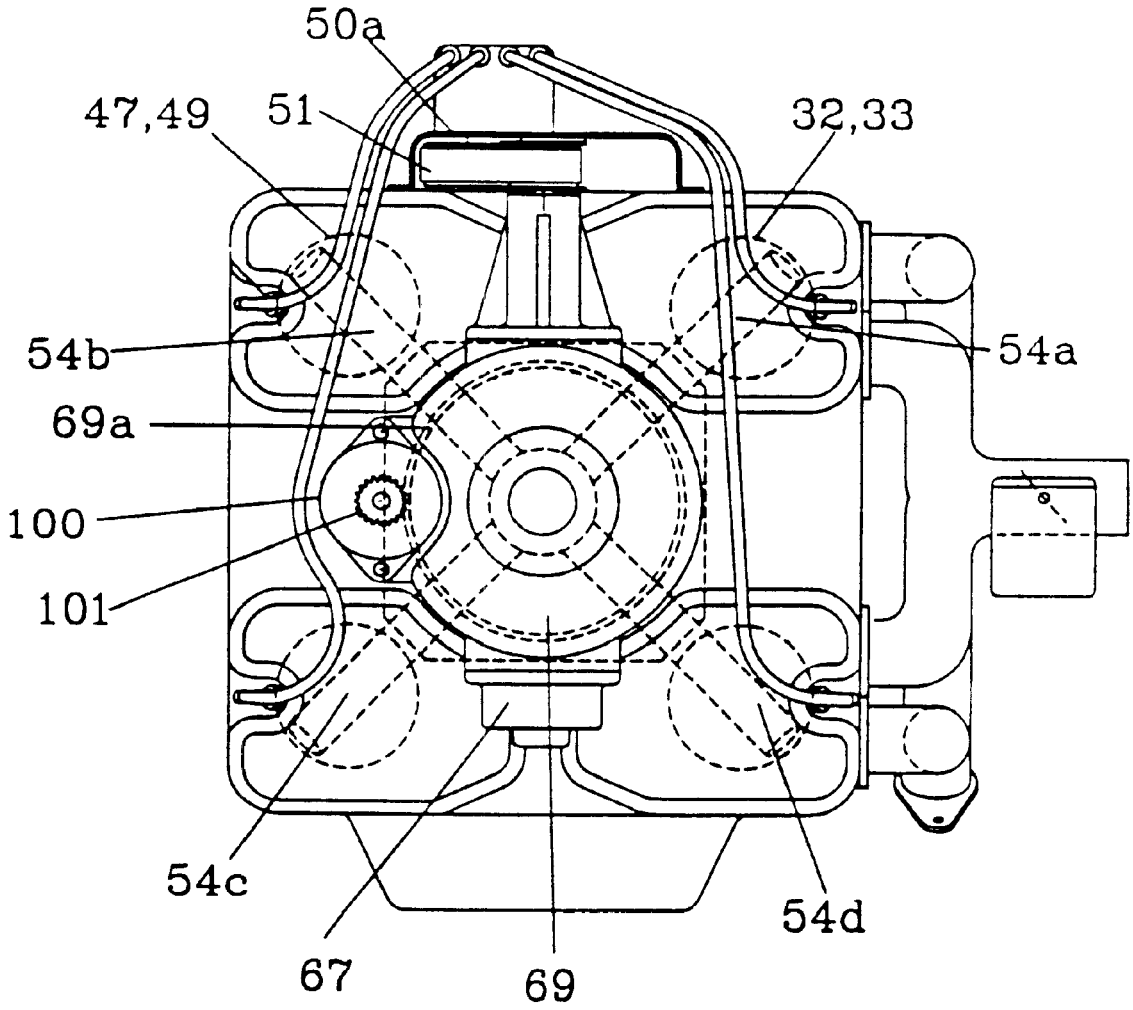
FIG. 11 is a left end view of FIG. 7.
Figure 12:
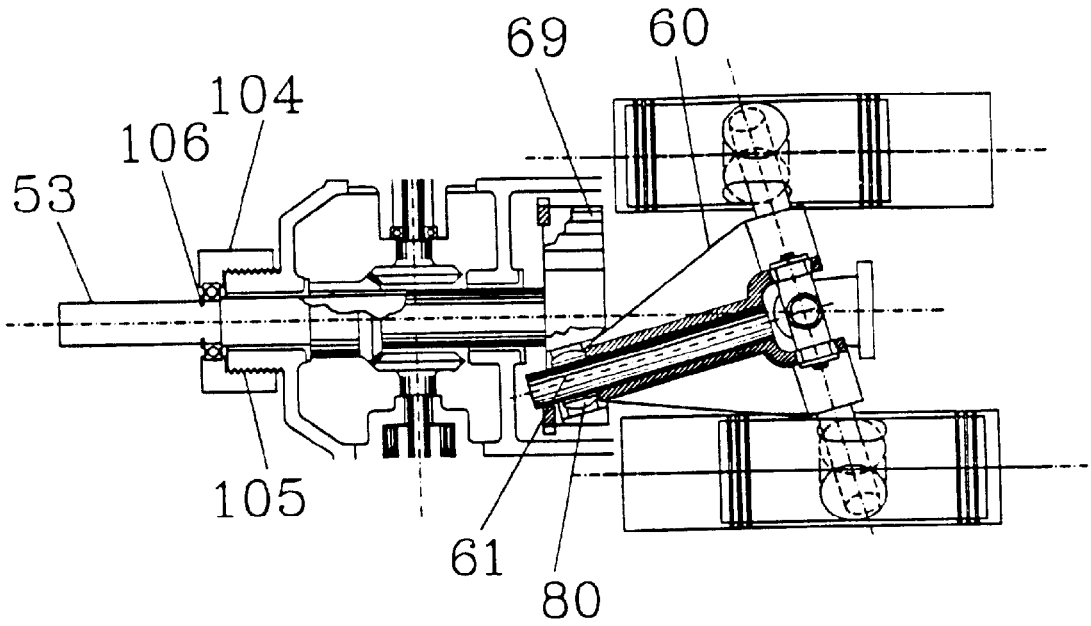
FIG. 12 is a partial top view of the engine of FIG. 7 showing the pistons, drive member and flywheel in a high compression position.
Figure 13:
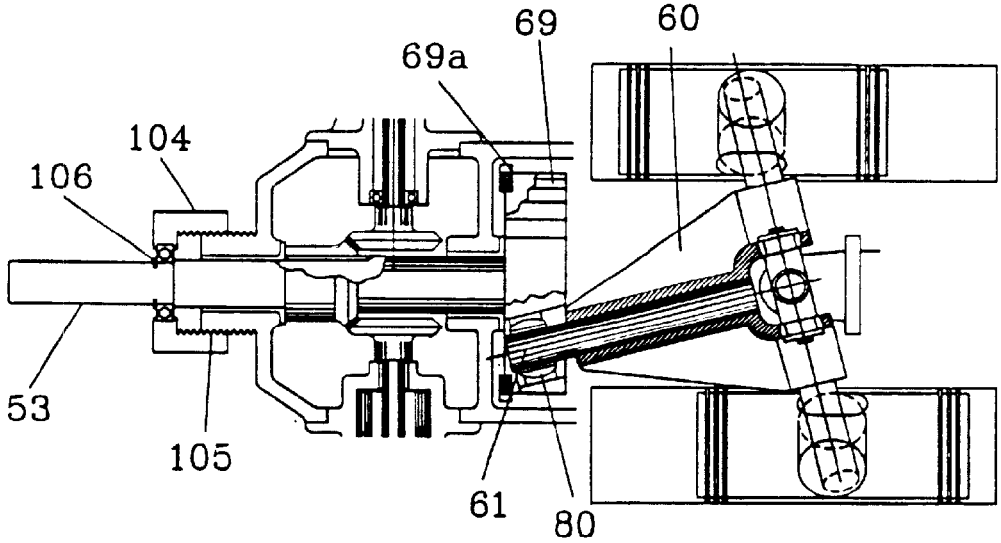
FIG. 13 is a partial top view of the engine in FIG. 7 showing the pistons, drive member and flywheel in a low compression position.

FIG. 11 is a front end view of engine 30 showing the relative positions of the cylinders and double ended pistons 32 -33, 32-*a*-33-*a*, 47-49 and 47-*a*-49-*a* with the four piston arms 54-*a*, 54-*b*, 54-*c* and 54-*d* positioned in the pistons. Pump 67 is shown below shaft 53, and pulley 50-*a* and timing belt 51 are shown at the top of engine 30. Starter 100 is shown with gear 101 engaging the gear teeth 69-*a* on flywheel 69.

Figure 14:
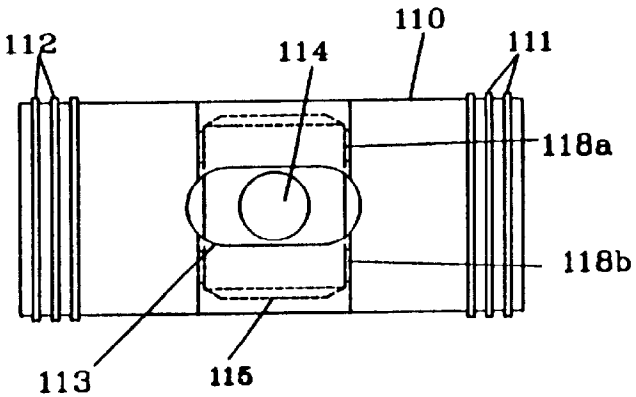
FIG. 14 is a top view of a piston.

The piston arms on the transition arm are inserted into sleeve bearings in a bushing in the piston. FIG. 14 shows a double piston 110 having piston rings 111 on one end of the double piston, and piston rings 112 on the other end of the double piston. A slot 113 is in the side of the piston. The location of the sleeve bearing is shown at 114.

Figure 15:
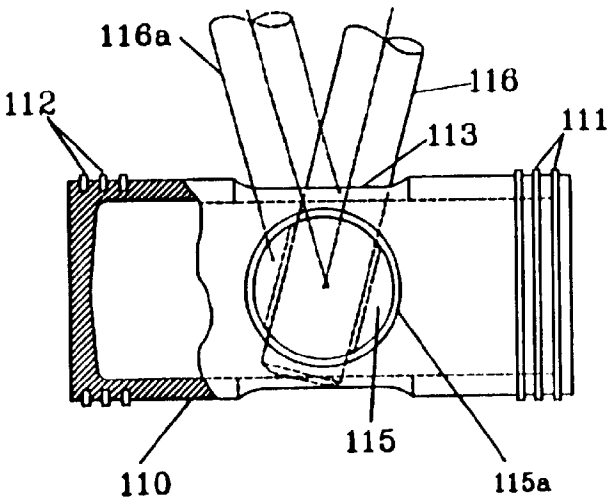
FIG. 15 is a side view of a piston showing the drive member in two positions.

FIG. 15 shows a piston arm 116 extending into piston 110 through slot 116 into sleeve bearing 117 in bushing 115. Piston arm 116 is shown in a second position at 116-*a*. The two pistons arms 116 and 116-*a* show the movement limits of piston arm 116 during operation of the engine.

Figure 16:
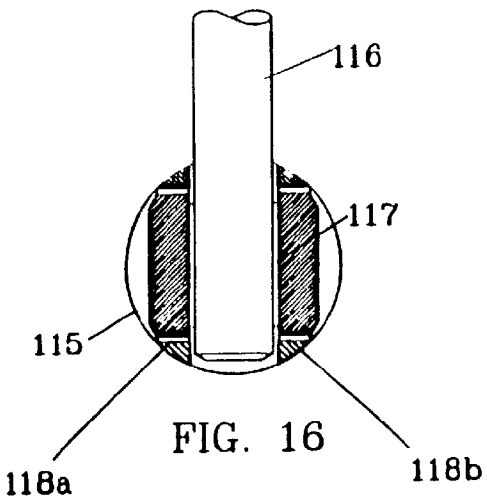
FIG. 16 shows the bearing interface of the drive member and the piston.

FIG. 16 shows piston arm 116 in sleeve bearing 117. Sleeve bearing 117 is in pivot pin 115. Piston arm 116 can freely rotate in sleeve bearing 117 and the assembly of piston arm 116, Sleeve bearing 117 and pivot pin 115 and sleeve bearings 118-*a* and 118-*b* rotate in piston 110, and piston arm 116 can moved axially with the axis of sleeve bearing 117 to allow for the linear motion of double ended piston 110, and the motion of a transition arm to which piston arm 116 is attached.

Figure 17:
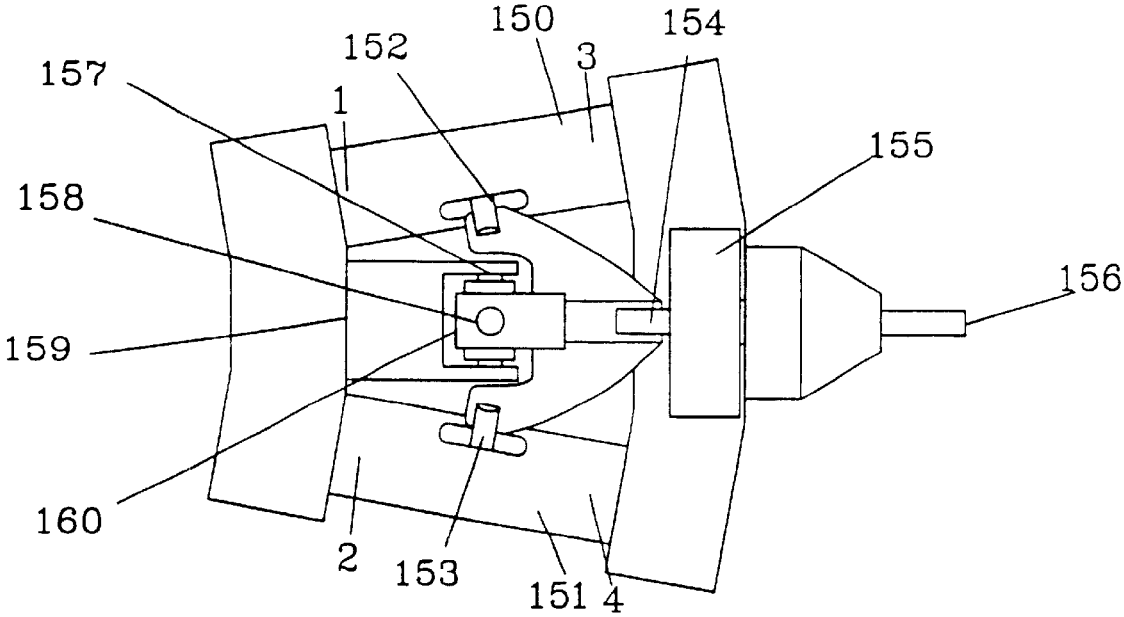
FIG. 17 shows an embodiment with slanted cylinders.

In the above embodiments, the cylinders have been illustrated as being parallel to each other. However, the cylinders need not be parallel. FIG. 17 shows an embodiment similar to the embodiment of FIGS. 1-6, with cylinders 150 and 151 not parallel to each other. Universal joint 160 permits the piston arms 152 and 153 to be at an angle other than 90 degree to the drive arm 154. Even with the cylinders not parallel to each other the engines are functionally the same.

Figure 18:
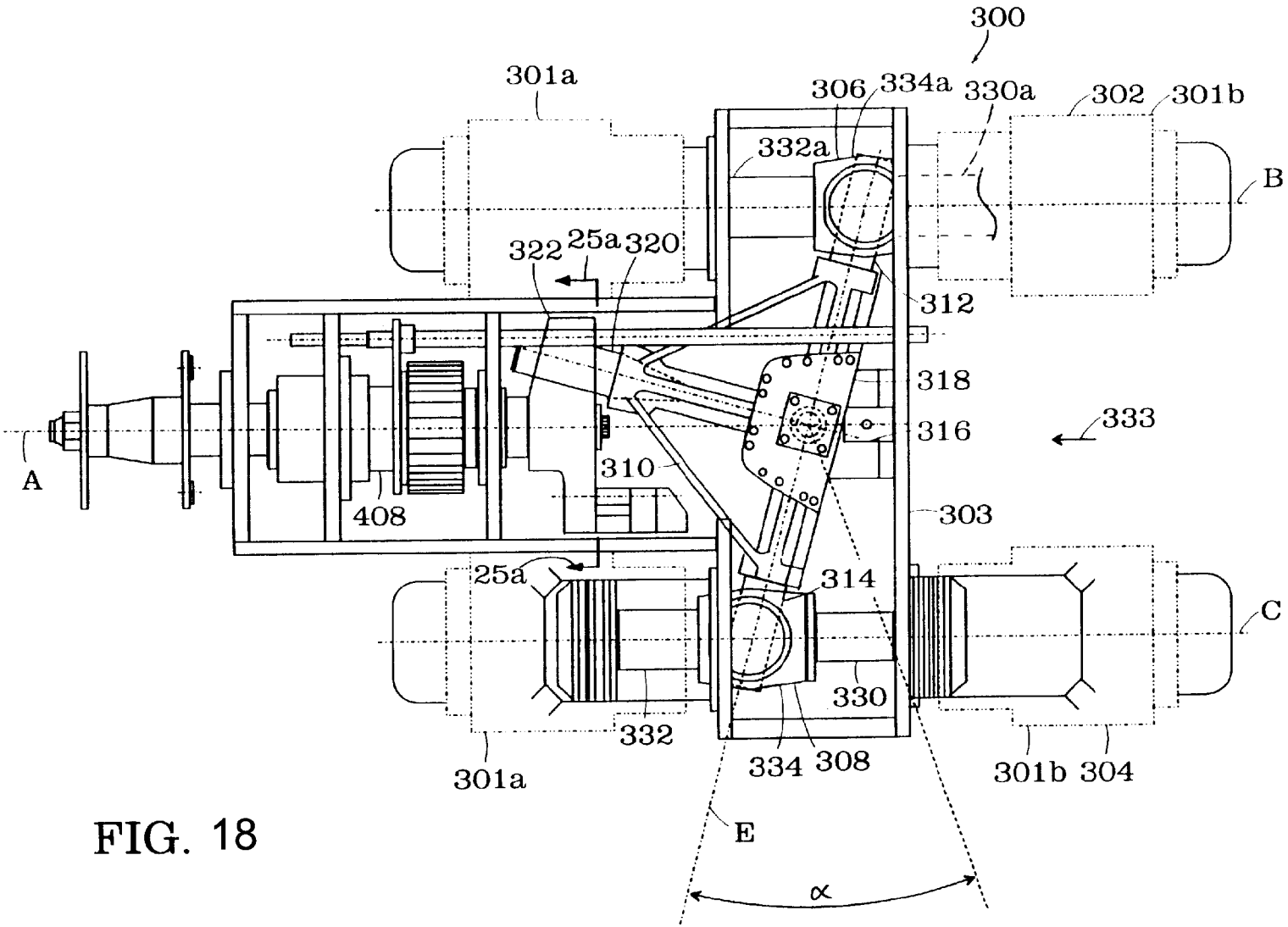
FIG. 18 is a top view of a two cylinder, double ended piston assembly.

Referring to FIG. 18, a two cylinder piston assembly 300 includes cylinders 302, 304, each housing a variable stroke, double ended piston 306, 308, respectively. Piston assembly 300 provides the same number of power strokes per revolution as a conventional four cylinder engine. Each double ended piston 306, 308 is connected to a transition arm 310 by a drive pin 312, 314, respectively. Transition arm 310 is mounted to a support 316 by, e.g., a universal joint 318 (U-joint), constant velocity joint, or spherical bearing. A drive arm 320 extending from transition arm 310 is connected to a rotatable member, e.g., flywheel 322.

Transition arm 310 transmits linear motion of pistons 306, 308 to rotary motion of flywheel 322. The axis, A, of flywheel 322 is parallel to the axes, B and C, of pistons 306, 308 (though axis, A, could be off-axis as shown in FIG. 17) to form an axial or barrel type engine, pump, or compressor. U-joint 318 is centered on axis, A.

Figures 19, 23A:
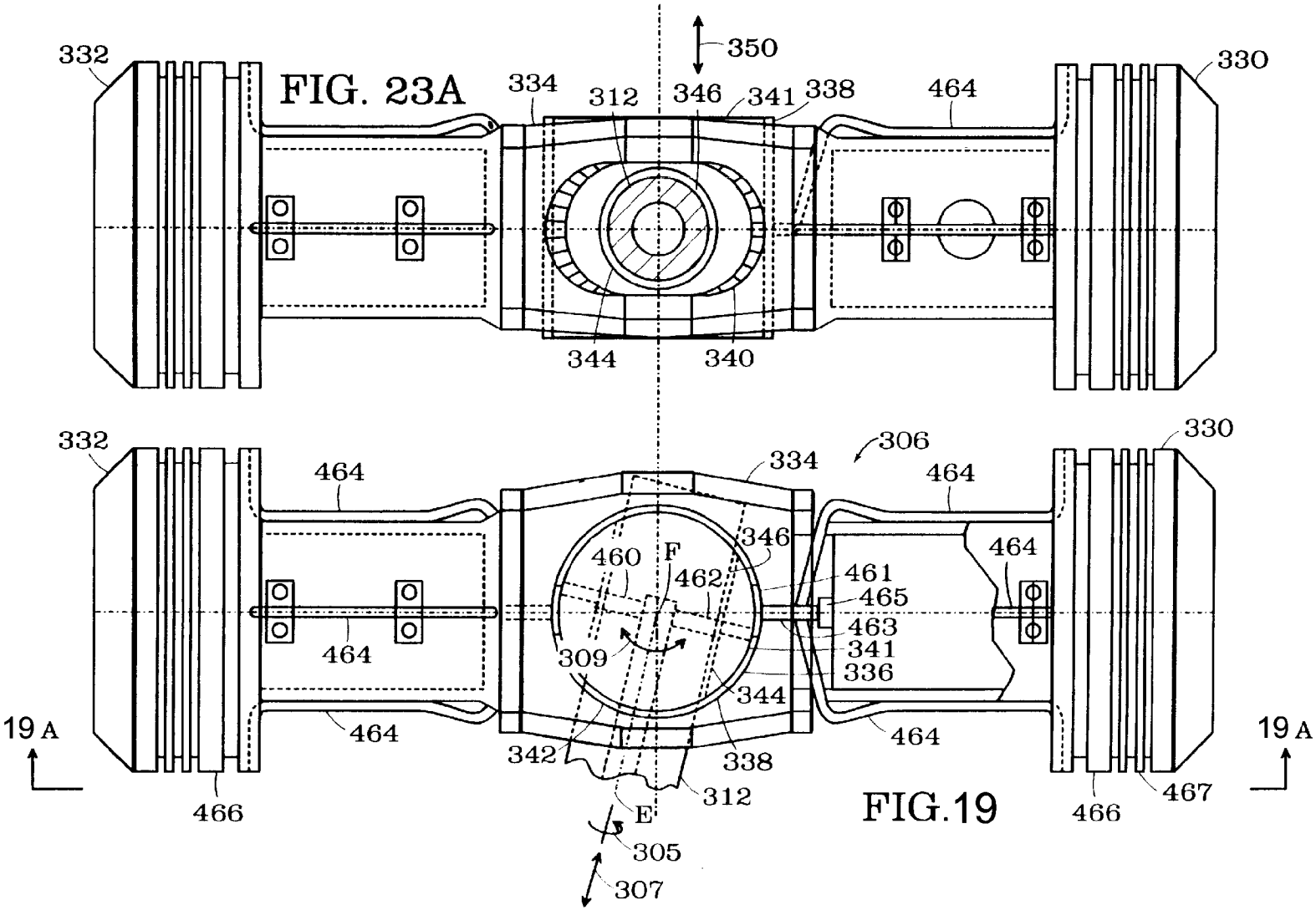
FIG. 19 is a top view of one of the double ended pistons of the assembly of FIG. 18.

Referring to FIGS. 18 and 19, cylinders 302, 304 each include left and right cylinder halves 301-*a*, 301-*b* mounted to the assembly case structure 303. Double ended pistons 306, 308 each include two pistons 330 and 332, 330-*a* and 332-*a*, respectively, joined by a central joint 334, 334-*a*, respectively. The pistons are shown having equal length, though other lengths are contemplated. For example, joint 334 can be off-center such that piston 330 is longer than piston 332. As the pistons are fired in sequence 330-*a*, 332, 330, 332-*a*, from the position shown in FIG. 22, flywheel 322 is rotated in a clockwise direction, as viewed in the direction of arrow 333. Piston assembly 300 is a four stroke cycle engine, i.e., each piston fires once in two revolutions of flywheel 322.

As the pistons move back and forth, drive pins 312, 314 must be free to rotate about their common axis E (arrow 305), slide along axis E (arrow 307) as the radial distance to the center line B of the piston changes with the angle of swing α of transition arm 310 (approximately ¬±15 degree swing), and pivot about centers F (arrow 309). Joint 334 is constructed to provide this freedom of motion.

Joint 334 defines a slot 340 (FIG. 19A) for receiving drive pin 312, and a hole 336 perpendicular to slot 340 housing a sleeve bearing 338. A cylinder 341 is positioned within sleeve bearing 338 for rotation within the sleeve bearing. Sleeve bearing 338 defines a side slot 342 shaped like slot 340 and aligned with slot 340. Cylinder 341 defines a through hole 344. Drive pin 312 is received within slot 342 and hole 344. An additional sleeve bearing 346 is located in through hole 344 of cylinder 341. The combination of slots 340 and 342 and sleeve bearing 338 permit drive pin 312 to move along arrow 309. Sleeve bearing 346 permits drive pin 312 to rotate about its axis E and slide along its axis E.

If the two cylinders of the piston assembly are configured other than 180 degrees apart, or more than two cylinders are employed, movement of cylinder 341 in sleeve bearing 338 along the direction of arrow 350 allows for the additional freedom of motion required to prevent binding of the pistons as they undergo a FIG. 8 motion, discussed below. Slot 340 must also be sized to provide enough clearance to allow the FIG. 8 motion of the pin.

Figure 20A:
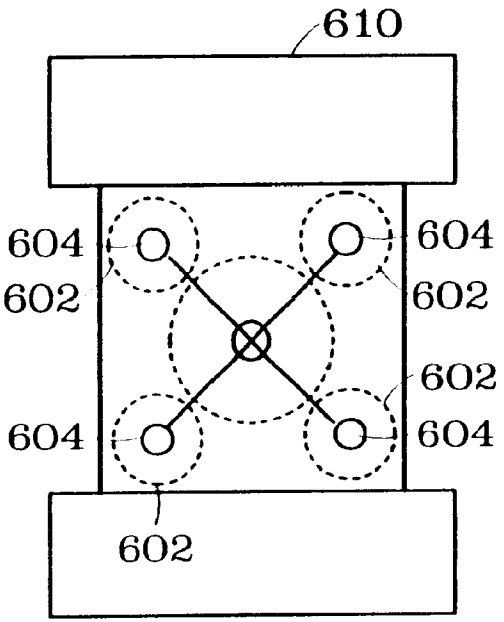
FIG. 20 is a top view of a four cylinder engine for directly applying combustion pressures to pump pistons.
Figure 20:
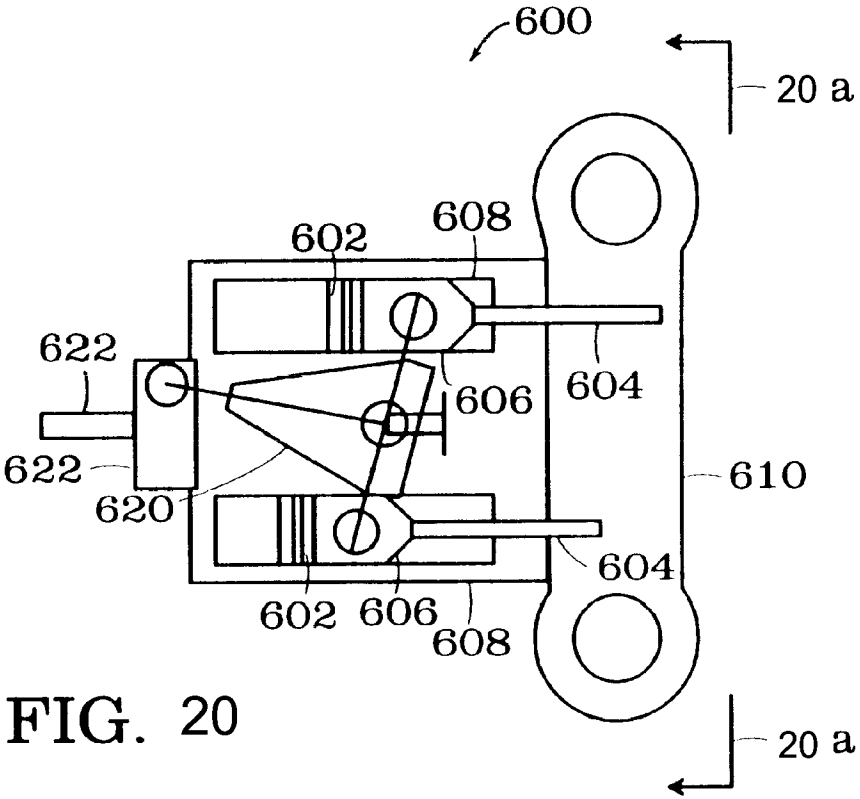

Engines according to the disclosure can be used to directly apply combustion pressures to pump pistons. Referring to FIGS. 20 and 20-*a*, a four cylinder, two stroke cycle engine 600 (each of the four pistons 602 fires once in one revolution) applies combustion pressure to each of four pump pistons 604. Each pump piston 604 is attached to the output side 606 of a corresponding piston cylinder 608. Pump pistons 604 extend into a pump head 610.

A transition arm 620 is connected to each cylinder 608 and to a flywheel 622, as described above. An auxiliary output shaft 624 is connected to flywheel 622 to rotate with the flywheel, also as described above.

The engine is a two stroke cycle engine because every stroke of a piston 602 (as piston 602 travels to the right as viewed in FIG. 20) must be a power stroke. The number of engine cylinders is selected as required by the pump. The pump can be a fluid or gas pump. In use as a multi-stage air compressor, each pump piston 606 can be a different diameter. No bearing loads are generated by the pumping function (for single acting pump compressor cylinders), and therefore, no friction is introduced other than that generated by the pump pistons themselves.

Figure 21A:
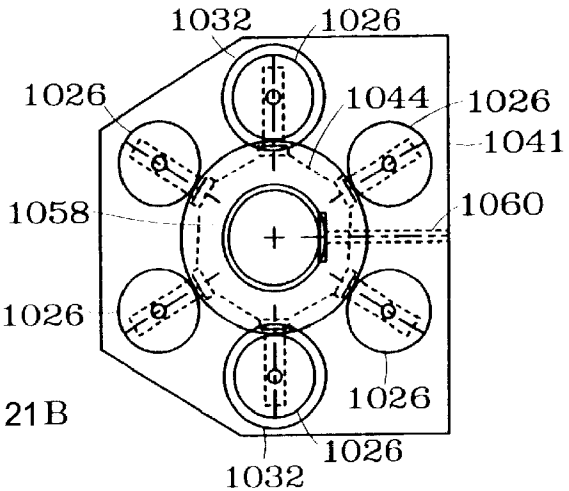
FIG. 21A is an end view.
Figure 21:
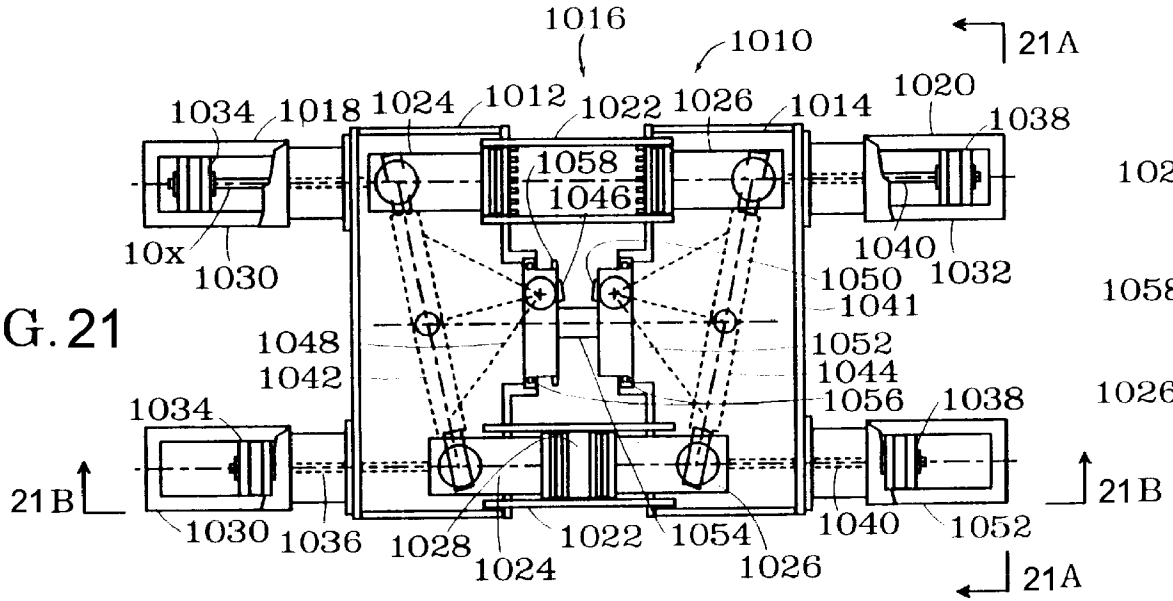
FIG. 21 is a top view of an engine/compressor assembly.
Figure 21B:
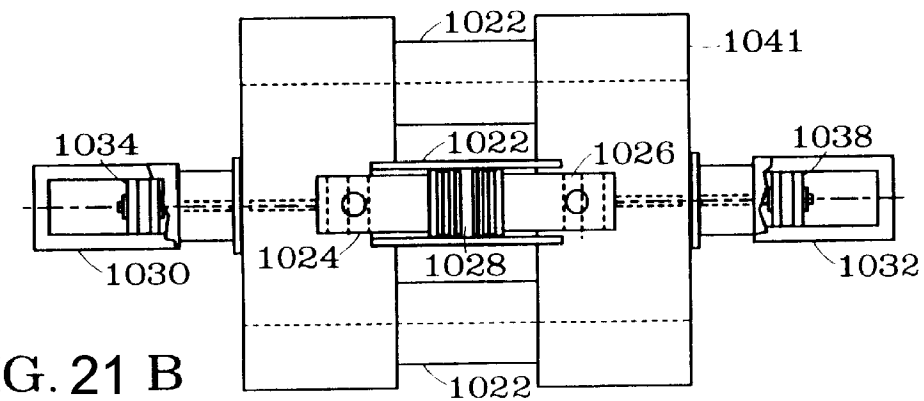
FIG. 21B is a side view of the engine/compressor assembly, taken along lines 21-A, 21-A and 21-B, 21-B, respectively, of FIG. 21.

Referring to FIGS. 21-21B, an engine 1010 having vibration cancelling characteristics and being particularly suited for use in gas compression includes two assemblies 1012, 1014 mounted back-to-back and 180 degree out of phase. Engine 1010 includes a central engine section 1016 and outer compressor sections 1018, 1020. Engine section 1016 includes, e.g., six double acting cylinders 1022, each housing a pair of piston 1024, 1026. A power stroke occurs when a center section 1028 of cylinder 1022 is fired, moving pistons 1024, 1026 away from each other. The opposed movement of the pistons results in vibration cancelling.

Outer compression section 1018 includes two compressor cylinders 1030 and outer compression section 1020 includes two compressor cylinders 1032, though there could be up to six compressor cylinders in each compression section. Compression cylinders 1030 each house a compression piston 1034 mounted to one of pistons 1024 by a rod 1036, and compression cylinders 1032 each house a compression piston 1038 mounted to one of pistons 1026 by a rod 1040. Compression cylinders 1030, 1032 are mounted to opposite piston pairs such that the forces cancel minimizing vibration forces that would otherwise be transmitted into mounting 1041.

Pistons 1024 are coupled by a transition arm 1042, and pistons 1026 are coupled by a transition arm 1044, as described above. Transition arm 1042 includes a drive arm 1046 extending into a flywheel 1048, and transition arm 1044 includes a drive arm 1050 extending into a flywheel 1052, as described above. Flywheel 1048 is joined to flywheel 1052 by a coupling arm 1054 to rotate in synchronization therewith. Flywheels 1048, 1052 are mounted on bearings 1056. Flywheel 1048 includes a bevel gear 1058 which drives a shaft 1060 for the engine starter, oil pump and distributor for ignition, not shown.

Engine 1010 is, e.g., a two stroke natural gas engine having ports (not shown) in central section 1028 of cylinders 1022 and a turbocharger (not shown) which provides intake air under pressure for purging cylinders 1022. Alternatively, engine 1010 is gasoline or diesel powered.

The stroke of pistons 1024, 1026 can be varied by moving both flywheels 1048, 1052 such that the stroke of the engine pistons and the compressor pistons are adjusted equally reducing or increasing the engine power as the pumping power requirement reduces or increases, respectively.

The vibration cancelling characteristics of the back-to-back relationship of assemblies 1012, 1014 can be advantageously employed in a compressor only system and an engine only system.

Figure 22:
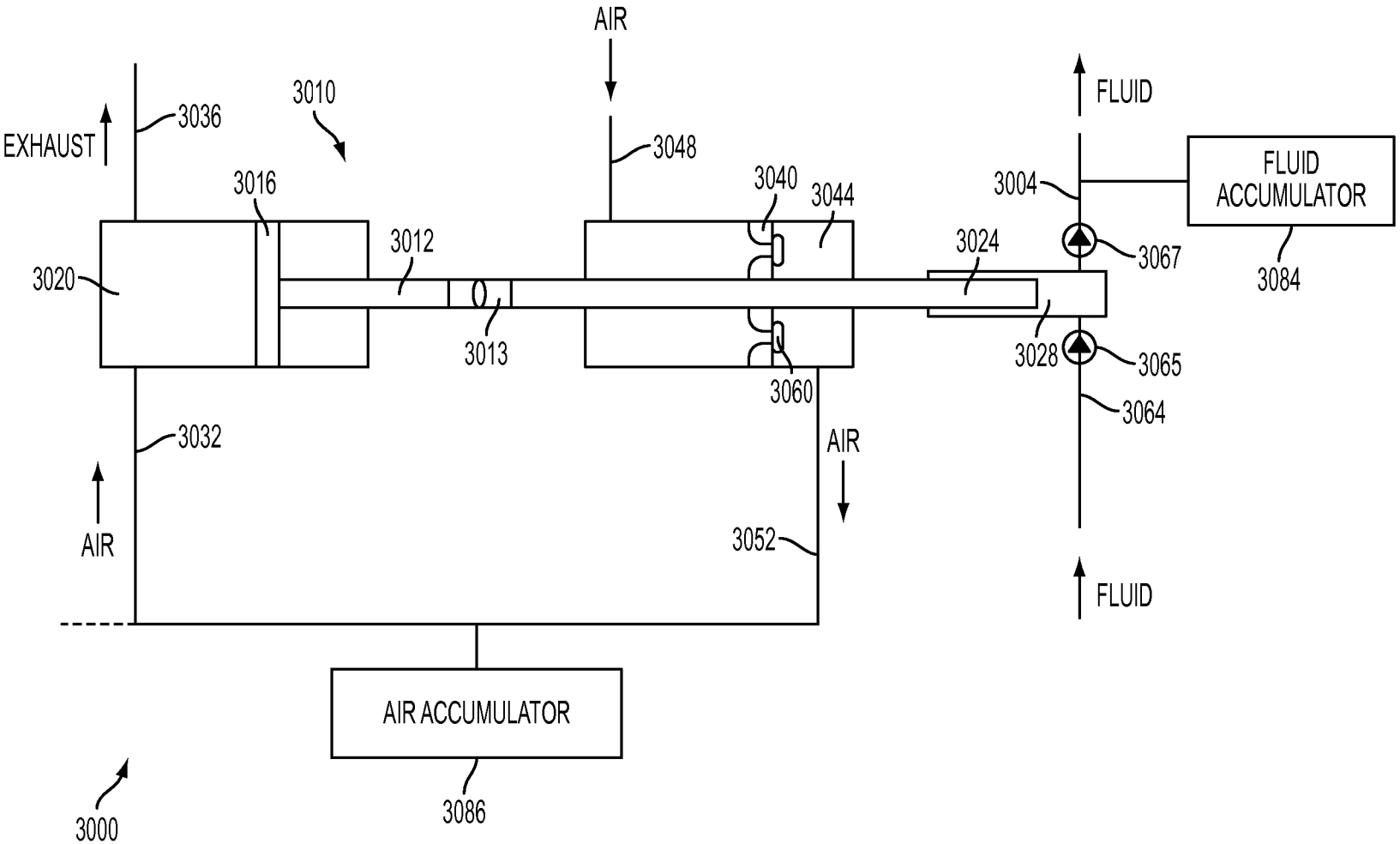
FIG. 22 is a schematic of the engine shown in FIG. 21, with the addition of a hydraulic chamber to the end of the compressor assembly.
Figure 23:
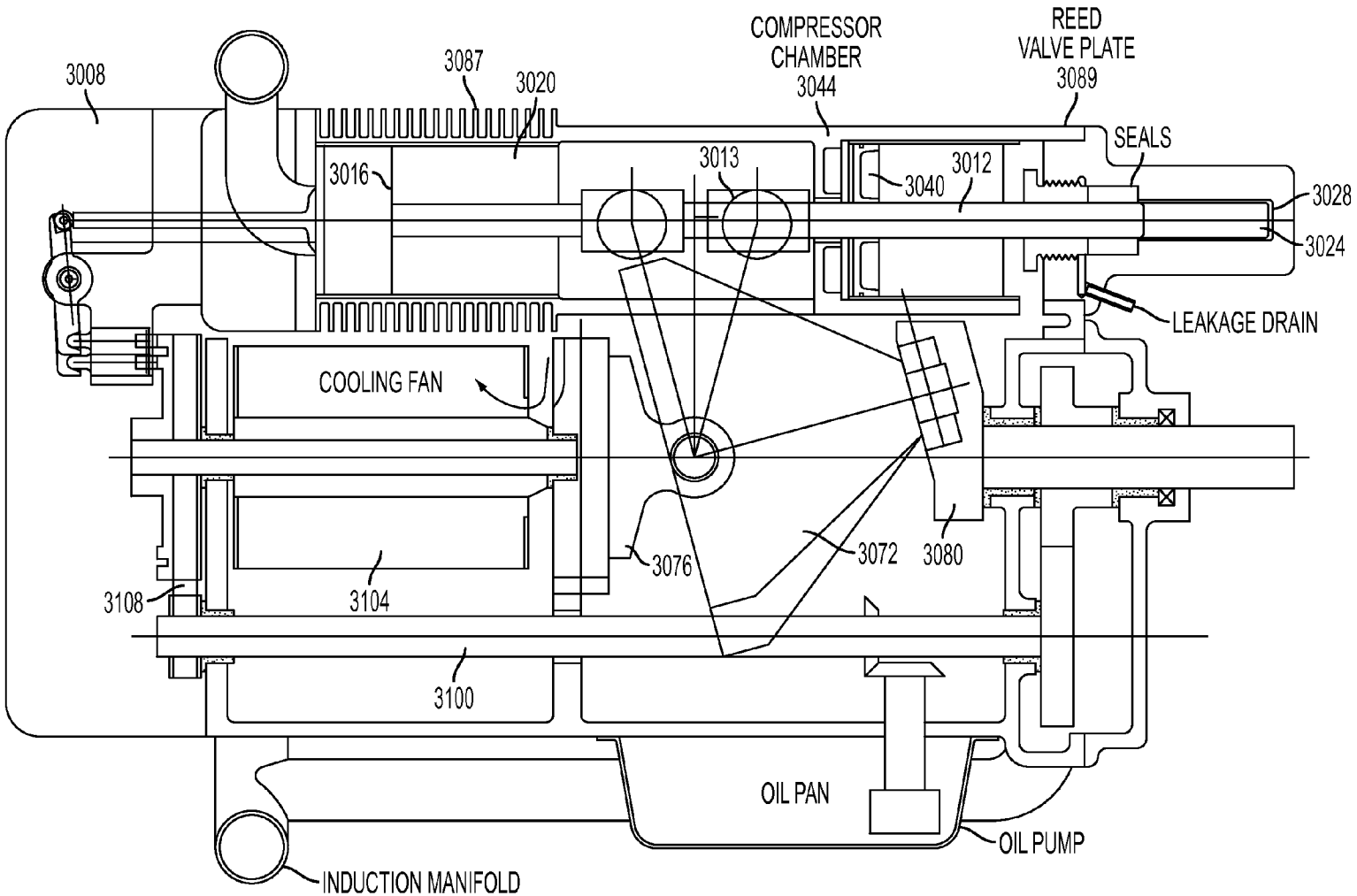
FIG. 23 is a partial cross sectional view of the engine shown in FIG. 22.

FIG. 22 is a schematic of the engine shown in FIG. 21 with improvements including the addition of a hydraulic chamber to the end of the compressor assembly. More particularly, FIGS. 22 and 23 illustrate a supercharged internal combustion engine 3000 including a pressurized fluid outlet 3004. The engine 3000 comprises an engine housing 3008 (see FIG. 23), and an assembly 3010 including a two-ended piston 3012, with one end 3016 received in a combustion chamber 3020, and another end 3024 received in a hydraulic chamber 3028. In the partial cut away of FIG. 23, the piston 3012 is shown in ghost in its pre-combustion position, and in solid in its post combustion position.

The combustion chamber 3020 has a combustion air inlet 3032 and a combustion exhaust outlet 3036. The piston 3012 further including a portion 3040 intermediate the two ends and received within an air chamber 3044. The portion 3040 has two sides, and is formed from a plate attached to the piston 3012 and about 2.758 inches in diameter. The air chamber 3044 has an air inlet 3048 and an air outlet 3052. The air outlet 3052 communicates with the combustion air inlet 3032, when the engine incorporates supercharging, although the air outlet could be used for other purposes, as suggested by the dashed line in FIG. 22.

The air inlet 3048 communicates with the air chamber 3044 on the one side of the portion 3040 and the air outlet 3052 communicates with the air chamber 3044 on the other side of the portion 3040. The engine 3000 further includes at least one valve means in the portion 3040 permitting air passage through the portion 3040 from one side to the other side. In the illustrated embodiment, the valve means is two reed valves 3060.

The hydraulic chamber 3028 has a fluid inlet 3064 including a first check valve 3065 and the fluid outlet 3004 includes a second check valve 3067. The engine 3000 further includes, as shown in FIG. 23, a transition arm 3072 coupled to a stationary support 3076, as described above, coupled to the piston 3012 at 3013, as described above, intermediate the one end 3016 and the portion 3040, and coupled to a rotating drive member 3080 rotatably mounted within the engine housing 3008. As shown in FIG. 22, each of the fluid outlet 3004 and the air outlet 3052 are connected to respective accumulators 3084 and 3086. In many instances, the air accumulator is simply the air outlet pipe.

More particularly, in the illustrated embodiment shown in FIG. 23, a finned combustion cylinder 3087 forms the combustion chamber 3020. In the illustrated embodiment, the diameter of the combustion chamber 3020 is about 2.69 inches. A cylinder 3089 forms the air chamber 3044. More particularly, the air chamber 3044 is an annulus in the cylinder 3089 and is formed around the piston portion 3040. The hydraulic chamber 3028 is formed by a housing 3091 only slightly larger than the other end 3024 of the piston 3012, and can include a lining for wear resistance. The diameter of the other end 3024 of the piston 3012 is about ⅛th of the size of the combustion chamber 3020. The amount of travel of the piston 3012 is about 2.24 inches. In other embodiments, other dimensions can be used.

The drive member 3080 drives a drive shaft 3100, and the drive shaft 3100 drives via a belt drive 3108 a cooling fan 3104. In other embodiments, not shown, a separate drive could be provided for the cooling fan 3104. In addition, the drive belt 3108 also operates a valve lifter in a conventional manner. Although only one piston assembly 3010 is shown in FIG. 23, the engine 3000 actually includes three such piston assemblies 3010, each one being driven in succession, thereby serving to return the other pistons to there pre-combustion position.

Thus, in operation, the piston 3012, as shown in FIG. 23, moves from left to right when combustion to the left of the left end of the piston 3012 occurs. The piston portion 3040 also moves to the right, compressing air in the air or compressor chamber 3044, and pushing the compressed air out of the air outlet 3052. The right end 3024 of the piston 3012 moves to the right in the hydraulic chamber 3028, forcing pressurized fluid out of the hydraulic chamber 3028 through the fluid outlet 3004. When the next piston fires, the piston 3012 shown in FIG. 23 moves back to the left by the transition arm 3072, first exhausting the combustion chamber 3020, and then allowing fresh compressed air into the combustion chamber 3020 prior to the next combustion. And, when the piston 3012 shown in FIG. 23 moves back to the left by the transition arm 3072, this allows fresh air to pass through the reed valves 3060, to the right of the piston portion 3040, and for fluid to enter the hydraulic chamber 3028.

The air chamber 3044 can be used not only for air, but also for any other gas. The fluid pumped can be water, or hydraulic fluid, or any other liquid.

The disclosed engine 3000 works well in a hybrid gasoline hydraulic vehicle, with the fluid pump being used to pressurize fluid (typically to 3,000 to 5,000 psi) for operation of hydraulic motors driving the vehicle's wheels. The output from the rotary drive member 3080 can be used for various purposes, but especially for driving auxiliary vehicle functions, such as such as generators, starters, power steering pumps and air conditioning compressors. The piston, chambers, transition arm and drive member can all be sized as appropriate to divide the engine power appropriately between the various engine outputs.

Various other features and advantages of the disclosure are apparent from the following claims.

The invention claimed is:

1. An assembly including at least one two-ended piston, with one end received in a combustion chamber, and another end received in a hydraulic chamber, said at least one two-ended piston further including a portion intermediate said two ends and received within an air chamber, said portion dividing said air chamber into two chambers, one on each side of said portion, said air chamber having an air inlet and an air outlet, said hydraulic chamber having a fluid inlet and a fluid outlet, and said combustion chamber having a combustion air inlet and a combustion exhaust outlet, wherein said air inlet communicates with said air chamber on one side of said portion and said air outlet communicates with said air chamber on an other side of said portion.

2. An assembly in accordance with claim 1, wherein said air outlet communicates with said combustion air inlet.

3. An assembly in accordance with claim 1, wherein said assembly further includes a transition arm coupled to a stationary support, and coupled to said at least one two-ended piston intermediate said one end and said portion.

4. An assembly in accordance with claim 3, wherein said transition arm is further coupled to a rotating drive member.

5. An assembly in accordance with claim 1, wherein said portion has two sides, and said assembly includes at least one valve permitting air passage through said portion from one side to an other side.

6. An assembly in accordance with claim 1, wherein said assembly includes at least three of said two-ended pistons.

7. A supercharged internal combustion engine including a pressurized fluid outlet, said engine comprising a two-ended piston, with one end received in a combustion chamber, and another end received in a hydraulic chamber, said combustion chamber having a combustion air inlet and a combustion exhaust outlet, said two-ended piston further including a portion intermediate said two ends and received within an air chamber, said portion having two sides and dividing said air chamber into two chambers, one on each side of said portion, said air chamber having an air inlet and an air outlet, said air outlet communicating with said combustion air inlet, said air inlet communicating with said air chamber on one side of said portion and said air outlet communicating with said air chamber on an other side of said portion, and said engine further including at least one valve in said portion permitting air passage through said portion from one side to the other side, said hydraulic chamber having a fluid inlet and a fluid outlet, and said engine further including a transition arm coupled to a stationary support, coupled to said two-ended piston intermediate said one end and said portion, and coupled to a rotating drive member.

8. A supercharged engine in accordance with claim 7 wherein said drive member driving a drive shaft, said drive shaft driving a cooling fan.

* * * * *